United States Patent [19]

Kida et al.

[11] Patent Number: 4,615,605

[45] Date of Patent: Oct. 7, 1986

[54] SEPARATION MECHANISM OF DEVELOPING DEVICE FROM PHOTORECEPTOR IN DIVIDING ELECTROPHOTOGRAPHIC COPYING MACHINE INTO TWO SECTIONS

[75] Inventors: Hiroshi Kida; Tutomu Kato, both of Yamatokoriyama; Masaru Nishijima, Hirakata, all of Japan

[73] Assignee: Sharp Kabushiki Kaisha, Osaka, Japan

[21] Appl. No.: 700,966

[22] Filed: Feb. 12, 1985

[30] Foreign Application Priority Data

Feb. 14, 1984 [JP] Japan ..... 59-27872

[51] Int. Cl.[4] ..... G03G 15/00

[52] U.S. Cl. ..... 355/3 R; 355/3 DD; 355/14 D

[58] Field of Search ..... 355/3 R, 3 DR, 3 DD, 355/16, 14 D; 118/657, 658

[56] References Cited

U.S. PATENT DOCUMENTS 4,339,196 7/1982 Beck et al. ..... 355/3 DD 4,376,577 3/1983 Okamoto ..... 355/3 DR

*Primary Examiner*—Arthur T. Grimley

*Assistant Examiner*—C. Romano

*Attorney, Agent, or Firm*—Birch, Stewart, Kolasch & Birch

[57] ABSTRACT

An electrophotographic copying machine of the type in which the copying machine is separated into two sections including a photoreceptor, a developing device, a supporting device for rotatably supporting the developing device so that the developing device is rotated as automatically being separated from the photoreceptor according to the self-weight of the developing device when the copying machine is separated into the two sections. Either the developing device or the photoreceptor can be replaced without damaging the surface of the photoreceptor at all.

2 Claims, 6 Drawing Figures

SEPARATION MECHANISM OF DEVELOPING DEVICE FROM PHOTORECEPTOR IN DIVIDING ELECTROPHOTOGRAPHIC COPYING MACHINE INTO TWO SECTIONS

BACKGROUND OF THE INVENTION

The present invention relates to an electrophotographic copying machine and, more particularly, to the structure of a developing device in an electrophotographic copying machine.

An electrophotographic copying machine produces an electrostatic latent image on a photoreceptor with an optical system. The latent image corresponds to an image on a copy document such as a manuscript or book to be copied. A developing device is provided so that toner particles are electrically adhered to the latent image, so that the latent image becomes visible as a toner image. The toner image is transferred onto a copy paper via a corona transference charger.

Undesirably, the paper may become jammed on the inner side of the electrophotographic copying machine. To remove the jammed paper, it is preferable to open the inner side of the copying machine by separating the machine into two sections. Further, it may be necessary to maintain or replace the inner elements such as the photoreceptor and the developing device within the copying machine. In such a case, the serviceman must take care not to damage the photoreceptor which is a delicate device. However, the conventional copying machine has not been constructed so that damage to the photoreceptor can be avoided with normal care.

SUMMARY OF THE INVENTION

Accordingly, it is an object of the present invention to provide an improved electrophotographic copying machine for easily inserting some element such as a developing device and a photoreceptor into the inside of the machine and removing the elements from the machine.

It is another object of the present invention to provide an improved electrophotographic copying machine for enabling some elements such as a developing device and a photoreceptor to be easily stored into and removed from the inside of the machine without damaging the surface of the photoreceptor.

It is a further object of the present invention to provide an improved electrophotographic copying machine for separating a developing machine and a photoreceptor from each other when replacing them.

It is yet a further object of the present invention to provide an improved electrophotographic copying machine for separating a photoreceptor and a developing device from each other in association with dividing the copying machine into an upper portion and a lower portion.

Briefly described, in accordance with the present invention, an electrophotographic copying machine in the type in which the copying machine is separated into upper and lower sections comprises photoreceptor means for forming an electrostatic latent image thereon, the surface of the photoreceptor means being very delicate, means positioned within the copying machine, and isolation means for automatically isolating the means from the photoreceptor according to the separation of the copying machine into the two sections.

In a specific form of the present invention, the copying machine further comprises developing means for developing the latent image of the photoreceptor means into a toner image, the photoreceptor means and the developing means being positioned in the upper section of the copying machine; supporting means for rotatably supporting the developing means so that the developing means is rotated separately from the photoreceptor means according to the weight of the developing means when the copying machine is separated into the two sections; rotating means provided in the upper portions of the copying machine, driving means disposed within the rotative means for transmitting a rotative force to the developing means, and means for rotating the rotating means so that the driving means of the rotating means is rotated to form a locus of follower means of the developing means rotating around the supporting means in synchronization with the separation of the copying machine.

Preferably, the rotating center of the rotating means is identical with the rotating center of the developing device.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 1:
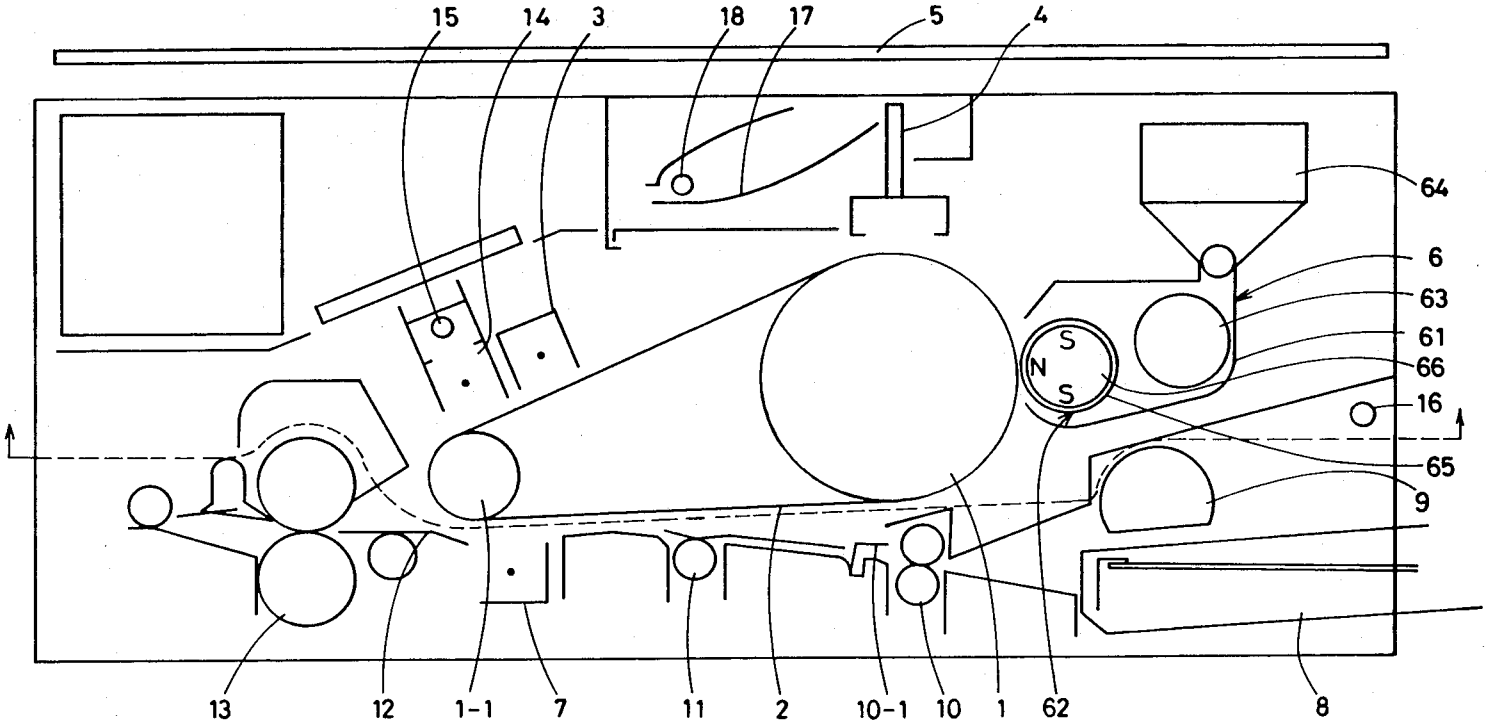
FIG. 1 is a sectional view of an electrophotographic copying machine according to the present invention.

FIG. 1 is a sectional view of an electrophotographic copying machine according to the present invention.

A drum 1 is provided to rotate a photoreceptor 2. The photoreceptor 2 is of an endless belt type. A copy document is disposed on a table 5. The table 5 carrying the copy document can be reciprocated. A copy lamp 18 and a reflection mirror 17 are provided for illuminating the reciprocating copy document to form its image, corresponding to the electrostatic latent image, onto the surface of the photoreceptor 2 with the operation of a charger 3 and a lens system 4. The latent image on the photoreceptor 2 is developed by a developing device 6 as a toner image. The toner image is electrostatically transferred onto a copy paper by a corona transference charger 7. This copy paper is supplied from a paper cassette 8 to be coupled to the body of the machine. A paper supply roller 9 is rotated to pick up a single copy paper. The picked up paper is transported to the corona transference portion with a PS roller 10 and a guide roller 11. The PS roller 10 and a PS plate 10-1 form paper transportation guide means, so that the front of the copy paper is positioned at the toner-image formation top on the photoreceptor 2 by transporting the copy paper in association with the rotation of the photoreceptor 2. In response to the transportation start signal, the PS plate 10-1 is opened to start to transport the copy paper.

The copied paper, after the corona transference is positioned adjacent the small roller 1—1 of the photoreceptor 2, so that it is automatically separated from the photoreceptor 2. The copied paper is guided by a guide plate 12 into fixing rollers 13 due to the pushing action of the photoreceptor 2. The fixing rollers 13 are heated to tightly fix the toner image onto the copied paper by the rotation thereof. The thus copied paper is removed from the body of the copying machine.

After the corona transference, the surface charges of the photoreceptor 2 are removed by a charge remover 14 and a charge removing lamp 15. When the photoreceptor 2 is faced with the developing device 6, the remaining toner of the photoreceptor 2 can be cleaned. After the charge is removed from the photoreceptor 2, the developing device 6 can thus serve to clean the surface of the photoreceptor 2 to remove the remaining toner. The photoreceptor 2 can be ready for the next copy operation.

A fulcrum 16 is provided for separating the copying machine into upper and lower portions, which is referred to herein as "lift-off separation".

As the primary feature of the present invention, while the copying machine is in the state of lift-off separation, some elements such as the developing device 6 can be separated from the photoreceptor 2 whose surface is very delicate. Any one or more elements other than the developing device 6 can be separated from the photoreceptor 2 during the lift-off separation. For example, it is assumed in the description hereinbelow that what is separated from the photoreceptor 2 is the developing device 6 because it is positioned adjacent to the photoreceptor 2.

Figure 2:
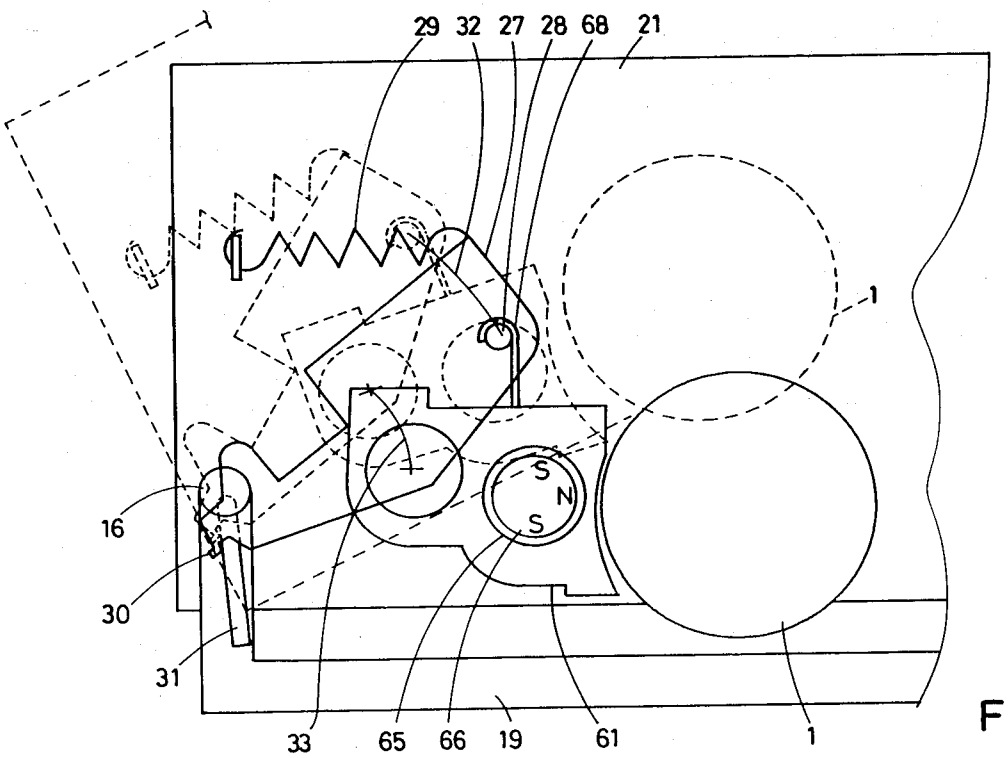
FIG. 2 is a side view of a developing device and moving means for moving the developing device according to the separation of the copying machine of FIG. 1, showing the two conditions when the upper and lower portions are combined and separated.

FIG. 2 is a side view of pivotal means for pivotally lifting off the copying machine, and moving means for moving the developing device 6 according to the lift-off separation of the copying machine.

As the pivotal means, a base 19 is provided to pivotally rotate an upper frame 21 around the fulcrum shaft 16. The upper frame 21 is opened against the base 19 at an angle of about 25 degrees as it is lifted off. The upper frame 21 supports the rotary drum 1, the charger 3, the lens system 4, the table 5, the developing device 6, the charge removing charger 14, the charge removing lamp 15, the reflection mirror 17, and the copy lamp 18 etc. These elements are all lifted up when the upper frame 21 of the copying machine is lifted off. They are all positioned above a separation line, which is denoted as a broken line in FIG. 1, when the upper frame 21 is lifted up.

The base 19 supports the paper pick-up roller 9, the coupling member for the paper cassette 8, the PS roller 10, the PS plate 10-1, the guide roller 11, the corona transference charger 7, the guide plate 12, and the fixing roller 13. These elements are all always positioned below the separation line, regardless of whether the upper frame 21 is lifted off or not.

Preferably, the developing device 6 is of the magnetic brush type in which a developer comprising carrier particles and toner particles is formed like a brush. The magnetic brush becomes in contact with the surface of the photoreceptor 2 for developing and cleaning. The developing device 6 is equipped with a developing housing 61, a roller 62, a stir roller 63, and a toner cartridge 64 for supplying the developer of the toner particles to the developing housing 61. The toner cartridge 64 is slidable to the developer inlet of the developing housing 61. It can be detached to replace the vain cartridge 64 with a new cartridge filled with developer. The developing roller 62 comprises a magnet 66 positioned within a non-magnetic sleeve 65, the magnet 66 being magnetized so that a plurality of alternative magnet poles are provided at the periphery of the magnet 66. A specific magnetic pole of the magnet 66 is faced opposing the photoreceptor 2, so that while the sleeve 65 is rotated, the developer is transferred onto the developing surface of the photoreceptor 2.

Figure 4:
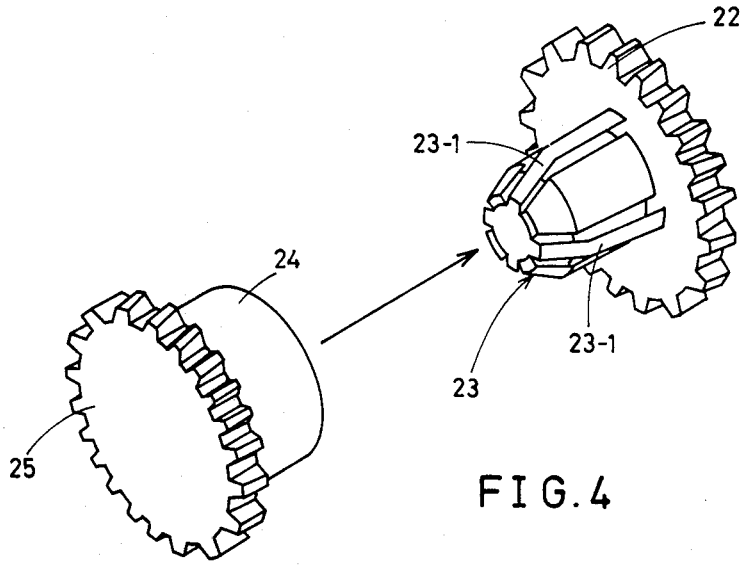
FIG. 4 is a perspective view of the transmission means for driving the developing device of the present invention.
Figure 5:
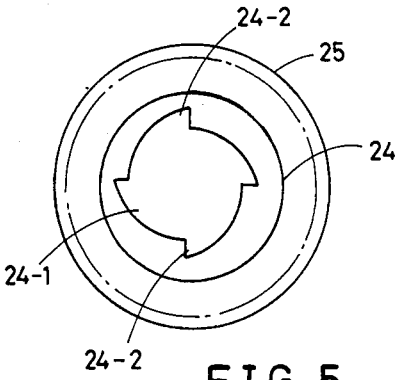
FIG. 5 is a plan view of follower means following the operation of the moving means of FIG. 4.
Figure 6:
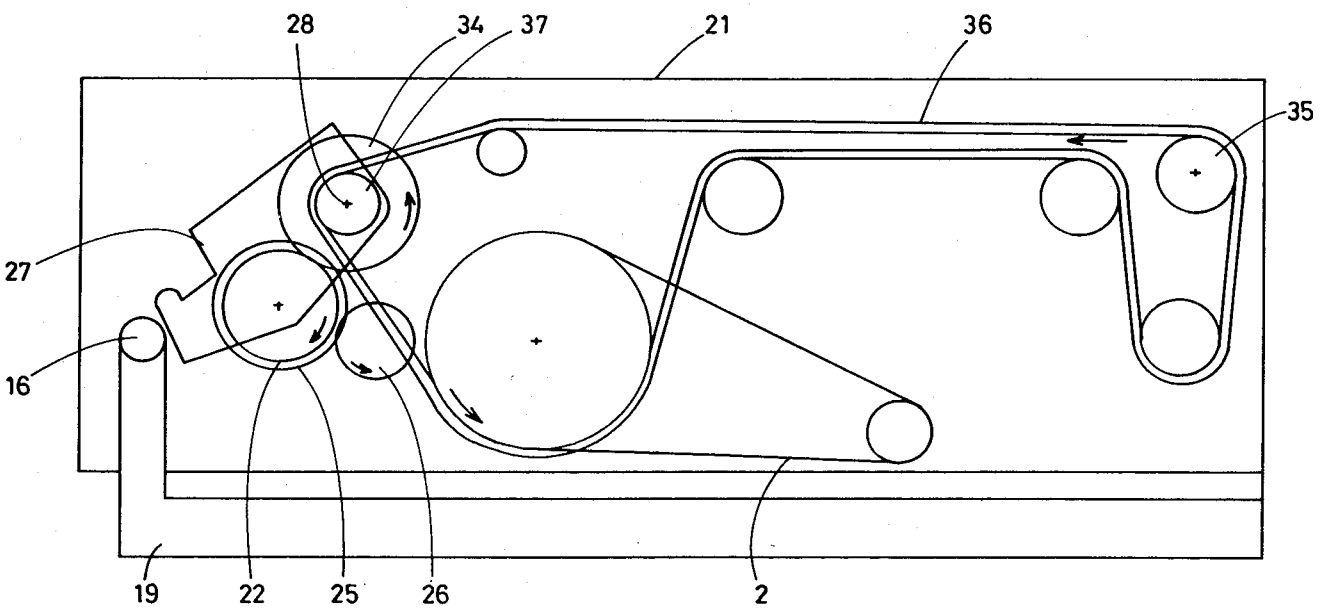
FIG. 6 is a side view of the primary elements of the moving means according to the present invention.

A moving member 23 and a follower 24 are provided. The moving member 23 is provided as a rotative center of a gear 22 positioned at the moving body when the developing device 6 is coupled to the copying machine. The follower 24 is rotatively coupled with the developing device 6. By engaging the moving member 23 with the follower 24, the sleeve 65 and the stir roller 63 are operated. The follower 24 is directly coupled with a shaft (not shown) of the stir roller 63. The shaft is rotatably coupled to the developing housing 61. As shown in FIG. 4, the follower 24 is integrally equipped with a gear 25. The follower 24 is also provided with an engagement opening 24-1 of FIG. 5 to which the moving member 23 is connected. The engagement opening 24-1 is formed as corresponding to a flat spring 23-1 to transfer the movement force from the moving member 23. When the flat spring 23-1 is engaged with a groove 24-2 of the engagement opening 24-1, the rotative force in the single direction is transferred from the moving member 23 to the follower 24. As shown in FIG. 6, the gear 25 is engaged with a gear 26 which is fixed to the sleeve 65. Therefore, the rotation force of the gear 22 is transferred by the moving member 23, the follower 24 (the shaft of the stir roller 63), the gear 25, and the gear 26, so that the stir roller 63 and the sleeve 65 are rotated simultaneously. A knob (not shown) for manual rotation is connected to the other end of the stir roller 63. The knob is operated to rotate the stir roller 63 in the driving direction, so that the flat spring 23-1 and the groove 24-2 are prevented from being engaged with each other, whereby the stir roller 63 can be rotated easily.

The gear 22 is rotatably supported by a moving angle bar 27. A supporting shaft 28 is provided for detachably and rotatably supporting the developing device 6. The angle bar 27 is rotatably supported by the supporting shaft 28. The supporting shaft 28 is positioned on the upper frame 21.

Figure 3:
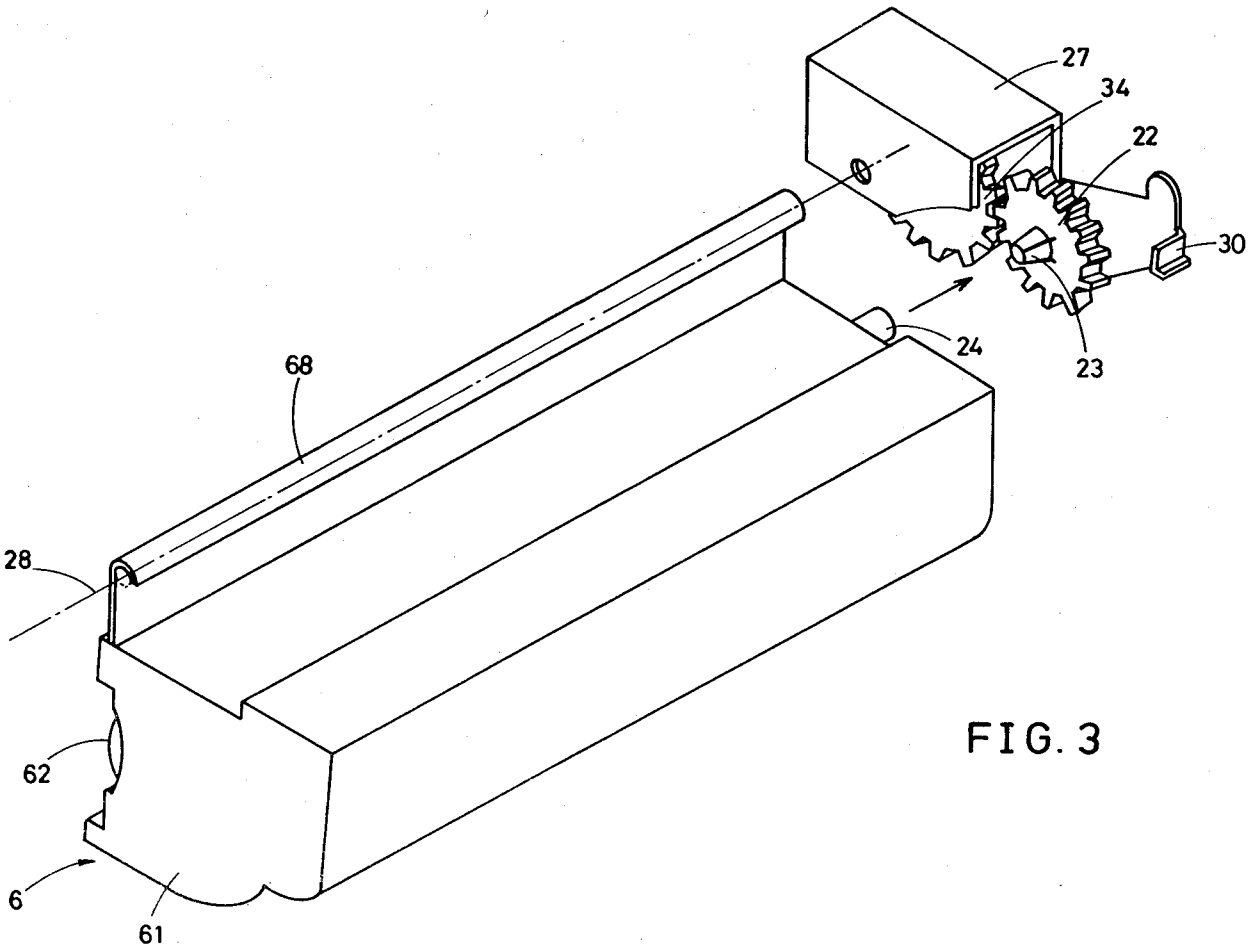
FIG. 3 is a perspective view of the photoreceptor and the moving means of FIG. 2.

As shown in FIG. 3, as the moving means for separating the developing means 6 far from the photoreceptor 2, a supporting member 68 of the developing device 6 is integrally combined with the developing housing 61. The supporting member 68 is rotatably coupled with the supporting shaft 28 on the upper frame 21 and is detachably connected to the shaft 28 because the end of the supporting member 68 is shaped as a reverse-U. Therefore, the developing device 6 is slidable along the supporting shaft 28. When the supporting member 68 is connected to the supporting shaft 28, the developing device 6 can be push innermost. To remove the developing device 6, it is pulled along the supporting member 28, so that the supporting member 68 is removed from the supporting shaft 28 to remove the developing device 6. Thus, the developing device 6 can be rotated against the supporting shaft 28, so that when the copying machine is lifted off and separated into its two parts, the developing device 6 is rotated away from the photoreceptor 2 with the supporting member 68 according to the weight of the developing device 6.

As stated above, the moving angle bar 27 is rotatably supported by the supporting shaft 28. As shown in FIG. 2, the angle bar 27 is biased in a single direction by a spring 29 one end of which is connected to the frame 21 and with the other end thereof connected to the moving angle bar 27. To regulate the rotation of the moving angle bar 27 against the bias a guide 30 is integrally provided at the end of the moving angle bar 27 for engaging with a guide angle bar 31 provided on the base 19. When the upper frame 21 is closed, the developing device 6 is positioned so that it faces the photoreceptor 2 at a predetermined distance and the developing device 6 is prevented from rotating around the supporting shaft 28. When the upper frame 21 is opened, the supporting shaft 28 is rotated around the fulcrum shaft 16 as denoted in the dotted line of FIG. 2. The locus of the supporting shaft 28 is denoted as a line 32 in FIG. 2. At the same time, the developing device 6 is rotated around the supporting shaft 28 according to its weight, so that it is substantially separated from the photoreceptor 2. A locus of the center of the follower 24 (the shaft of the stir roller 63) connected to the developing housing 61 of the developing device 6 is denoted by a line 33 of FIG. 2. The center of the moving member 23 coupled to the moving angle bar 27 follows the locus 33 according to the lift-off separation operation of the upper frame 21.

More specifically, when the upper frame 21 is lifted off, the moving angle bar 27 is also moved upward. However, it is uncertain whether the moving member 23 can follow the locus 33. To enable the moving angle bar 27 to rotate around the supporting shaft 28 by self-weight, it will form another locus different from the locus of the developing device 6. Thus, if the upper frame 21 cannot be rotated to a middle distance, the center of the moving member 23 cannot correspond to the center of the follower 24, so that it becomes difficult to attach the developing device 6. To eliminate the difference of the center between the moving member 23 and the follower 24, the moving angle bar 27 is provided with the guide 30. The guide 30 is engaged with the guide angle bar 31, so that the center of the moving member 23 of the moving angle bar 27 is rotated as forcibly corresponding to the locus 33 of the follower 24 of the developing device 6 in association with the lift-off separation operation of the upper frame 21. To assure that the center of the moving member 23 of the moving angle 27 should correspond to the locus 33, the guide angle bar 31 and the guide 30 are shaped. The biasing spring 29 is connected to the moving angle bar to assure the engagement between the guide 30 and the guide angle bar 31. It may be possible to omit the spring 29 if the self-weight of the moving angle bar 27 can assure continuous engagement.

The gear 22 provided on the moving angle bar 27 is engaged with the gear 34 which is rotatably coupled to the supporting shaft 28. As shown in FIG. 6, the gear 34 can be rotated by the rotational force of a main motor 35 provided on the upper frame 21 which is transferred to a sprocket 37 via a chain 36, the sprocket 37 being coupled to the gear 34. The gear 34 and the sprocket 37 are coupled together coaxially. The chain 36 passes the rotational force to a sprocket coupled to the shaft of the drum 1, so that the photoreceptor 2 can be rotated.

According to the feature of the present invention, this arrangement provides that when the upper frame 21 is lifted off and opened, the developing device 6 is rotated around the supporting shaft 28 due to its self-weight as shown in the dotted line of FIG. 2. Since the developing device 6 faces the photoreceptor 2 before the lift-off operation, the developing device 6 can be removed from the photoreceptor 2 in response to the lift-off separation of the upper frame 21, so that the developing device 6 and/or the photoreceptor 2 can be safely removed and re-inserted during the separation and combination of the upper and lower portions of the copying machine. Therefore, damage of the photoreceptor 2 can be prevented.

When the supporting shaft 28 is rotated to the position as denoted in the dotted line of FIG. 2, the developing device 6 is also rotated to the position of the dotted line according to the self-weight. The rotation locus of the follower 24 at this time is denoted by the locus 33. The center of the moving member 23 of the moving angle bar 27 indicates the same locus as the locus 33 of the center of the follower 24, via the guide 30 and the guide angle bar 31, in association with the rotation of the supporting shaft 28. Regardless of whether the upper frame 21 is stopped at any opening angle, the developing device 6 can be easily and exactly detached and attached because the center of the follower 24 is identical with the center of the moving memeber 23. For insertion, the supporting member 68 of the developing device 6 is coupled to the supporting shaft 28, so that the developing device 6 is inserted as falling with the self-weight, whereby the engagement opening 24-1 of the follower 24 is inserted into the moving member 23 and the groove 24-2 of the engagement opening is engaged with the flat spring 23-1.

Besides, when the developing device 6 is drawn out, the movement of the follower 24 is not limited by the operation of the moving member 23, whereby the developing device 6 can be smooth drawn out, because the center of the follower 24 is identical with the center of the moving member 23. When the frame 21 is opened, the movement of the follower 24 is not limited by the operation of the moving member 23, so that no violation of the lift-off separation due to these loads is possible and no violation of the rotation of the developing device 6 is caused to thereby smoothly separate the developing device 6 from the photoreceptor 2. Thus, the upper frame 21 can be easily opened.

As described above, in accordance with the present invention, in a specific copying machine of the type in which the copying machine is separated into upper and lower sections, the developing device is rotatably supported with a shaft capable of being separated from the photoreceptor in the lift-off upper section. The rotating means for driving the developing device during the copy operation is constructed as being rotatable in such a manner that the rotating means always corresponds to the follower means of the rotating means, regardless of the lift-off separation of the copying machine. The developing device can be easily removed from and attached to the inner body of the copying machine. The developing device can be separated far from the very delicate surface of the photoreceptor, so that in addition to the developing device, the photoreceptor can be easily removed from and attached to the inner body of the copying machine.

While only certain embodiments of the present invention have been described, it will be apparent to those skilled in the art that various changes and modifications may be made therein without departing from the sprit and scope the present invention as claimed.

What is claimed is:

1. An electrophotographic copying machine which is separable into upper and lower portions comprising:

photoreceptor means for forming an electrostatic latent image thereon;

developing means for developing the latent image into a toner image, said developing means being provided with a follower;

said photoreceptor means and said developing means being positioned in the upper portion of said copying machine;

supporting means for rotatably supporting said developing means;

a moving angle bar rotatably supported by the supporting means, said moving angle bar being provided with a moving member;

a guide angle bar mounted on the lower portion of the copying machine; and a guide means provided at the end of the moving angle bar for engaging with the guide angle bar whereby when the upper portion is closed on the lower portion, the developing means faces the photoreceptor and the developing means is prevented from rotating and when the upper portion rotates to an open position, the developing means rotates and separates from the photoreceptor means using the weight of said developing means, said moving member of the moving angle bar rotating in a path corresponding to the follower of the developing means.

2. The electrophotograhic copying machine of claim 1 wherein a spring means is connected to the moving angle bar to assure the engagement between the guide means and the guide angle bar.

* * * * *